US006634537B2

(12) United States Patent
Chen

(10) Patent No.: US 6,634,537 B2
(45) Date of Patent: Oct. 21, 2003

(54) DETACHABLE INSULATION WIRE-PRESSING ELEMENT OF A STAPLING DEVICE

(76) Inventor: Tung-I Chen, P.O. Box 82-144, Taipei (TW)

( * ) Notice: Subject to any disclaimer, the term of this patent is extended or adjusted under 35 U.S.C. 154(b) by 0 days.

(21) Appl. No.: 09/934,719

(22) Filed: Aug. 23, 2001

(65) Prior Publication Data

US 2003/0038153 A1 Feb. 27, 2003

(51) Int. Cl.[7] ..... B25C 5/00

(52) U.S. Cl. ..... 227/140; 227/119; 227/151; 227/15; 227/18; 411/469

(58) Field of Search ..... 227/140, 15, 18, 227/120, 119, 151, 61; 248/547, 548, 71; 174/159; 411/442, 443, 444, 469, 457, 356, 439, 40, 41, 39

(56) References Cited

U.S. PATENT DOCUMENTS 662,587 A * 11/1900 Blake ..... 174/159
3,085,129 A * 4/1963 Anderson ..... 174/159
4,127,250 A * 11/1978 Swick ..... 248/71
4,582,288 A * 4/1986 Ruehl ..... 248/547
4,801,061 A * 1/1989 Mangone, Jr. ..... 227/120
4,805,824 A * 2/1989 Erickson ..... 227/120
5,735,444 A * 4/1998 Wingert ..... 227/119

* cited by examiner

*Primary Examiner*—Rinaldi I. Rada
*Assistant Examiner*—Thanh Truong
(74) *Attorney, Agent, or Firm*—Leong C. Lei

(57) ABSTRACT

A detachable insulation wire-pressing element of a stapling device is disclosed. The wire-pressing element has a wire-pressing section at the center of the element and the bottom face of the wire-pressing section is provided with a wire slot having an opening facing downward the two sides of the wire-pressing section are respectively provided with a corresponding nailing hole, and the nailing hole is corresponding to a staple-impacting plate of the stapling device, thereby a wire-pressing element is formed. When the front edge of the wire-pressing element is aligned with the front edge of the stapling device the nailing holes are corresponding to the staple-impacting plate of the stapling device, and thereby a staple row utilized in the stapling device and by aligning the wire-pressing element with the front edge of the stapling device, the wire-pressing element can be used to secure insulation wires. The wire-pressing element can be utilized in stapling device for outdoors and indoors.

1 Claim, 7 Drawing Sheets

DETACHABLE INSULATION WIRE-PRESSING ELEMENT OF A STAPLING DEVICE

BACKGROUND OF THE INVENTION (a) Field of the Invention

The present invention relates to a detachable insulation wire-pressing element of a stapling device, and in particular, to a wire-pressing element having a wire-pressing section and nailing holes allowing a stapling device to secure wires or the like at indoors or outdoors.

(b) Description of the Prior Art

As shown in FIGS. 1 and 2, there is shown a conventional stapling device for mounting wires of an article (electrical appliance) which utilizes a "II" shaped staple row 20. The stapling device has a body 10 having a "u" shaped slot seat 11. The two sides of the slot seat 11 are correspondingly formed with a staple slot 12 for the sliding of the "II" shaped staple row 20. The pushing seat 13 at the rear portion of the body 10 pushes forward the staple row 20, and the front end of the interior of the body 10 is provided with a staple-impacting plate 14 to force out a staple from the staple row 20. The bottom face of the body 10 has an arch-shaped wire slot seat 15 for the positioning of wire so that the staple row 20 can be forced out and smoothly secures the wire.

The above mounting utilizing the staple row 20 of wire at outdoors may be damaged by weather factors or other factors. The metal within the wire may come into contact with the staple row 20. As no insulation is provided to the staple row 20, electrocution may occur. As a result, this type of staple row 20 is not used at outdoors.

As shown in FIGS. 3 and 4, in order to overcome the drawback of the staple row 20, a wire-pressing seat 40 having staple body 45 has developed. This wire-pressing seat 40 is only utilized with the staple for outdoor. The bottom face of the interior of the body of the stapling device is provided with a "u"-shaped slot seat 31 and the wire-pressing seat 40 is located within the slot seat 31, and is urged by the pushing seat 33 at the rear of the slot seat 31. The staple-impacting plate 34 knocks onto the staple body 45 and the wire-pressing seat 40 is forced out, one by one, to secure the wire within the wire slot seat 35.

The conventional wire-pressing seat 40 has solved the drawback of electrocution, however, the large volume wire-pressing seat 40 has to be mounted within the slot seat 31 of the stapling device as the capacity of the slot seat 31 is limited, the user has to continuously re-fill the wire-pressing seat 40. Thus, it is inconvenient in actual operation.

At the same time, the staple body 45 on the wire-pressing seat 40 has to be one by one, inserted onto the wire-pressing seat 40 in the process of manufacturing, the speed of manufacturing is slow and the cost of manufacturing is high.

In view of the above, the indoor use and outdoor use stapling devices pose individual drawbacks, and the slots seats are different from each other. Therefore, they cannot be used for both devices. In operation, the user needs to bring along with two stapling devices to conform to the requirements. Therefore, it is a troublesome for the user in operating the stapling device. Accordingly, it is an object of the present invention to provide a detachable insulation wire-pressing element of a stapling device, which can mitigate the above drawbacks.

SUMMARY OF THE INVENTION

Accordingly, it is an object of the present invention to provide a detachable insulation wire-pressing element of a stapling device, wherein the wire-pressing element is detachable from the stapling device, thereby the stapling device can be used at outdoors and indoors.

Yet another object of the present invention to provide a detachable insulation wire-pressing element of a stapling device, wherein the wire-pressing element has a wire-pressing section at the center of the element and the bottom face of the wire-pressing section is provided with a wire slot having an opening facing downward, the two sides of the wire-pressing section are respectively provided with a corresponding nailing hole, and the nailing hole is corresponding to a staple-impacting plate of the stapling device, thereby a wire-pressing element is formed. The stapling device can be used indoors and outdoors and provides convenient operation and the economic effectiveness of the stapling device is improved.

Other object and advantages of the present invention will become more apparent from the following description taken in conjunction with the accompanying drawing.

DETAILED DESCRIPTION OF THE PRESENT INVENTION

Figure 1:
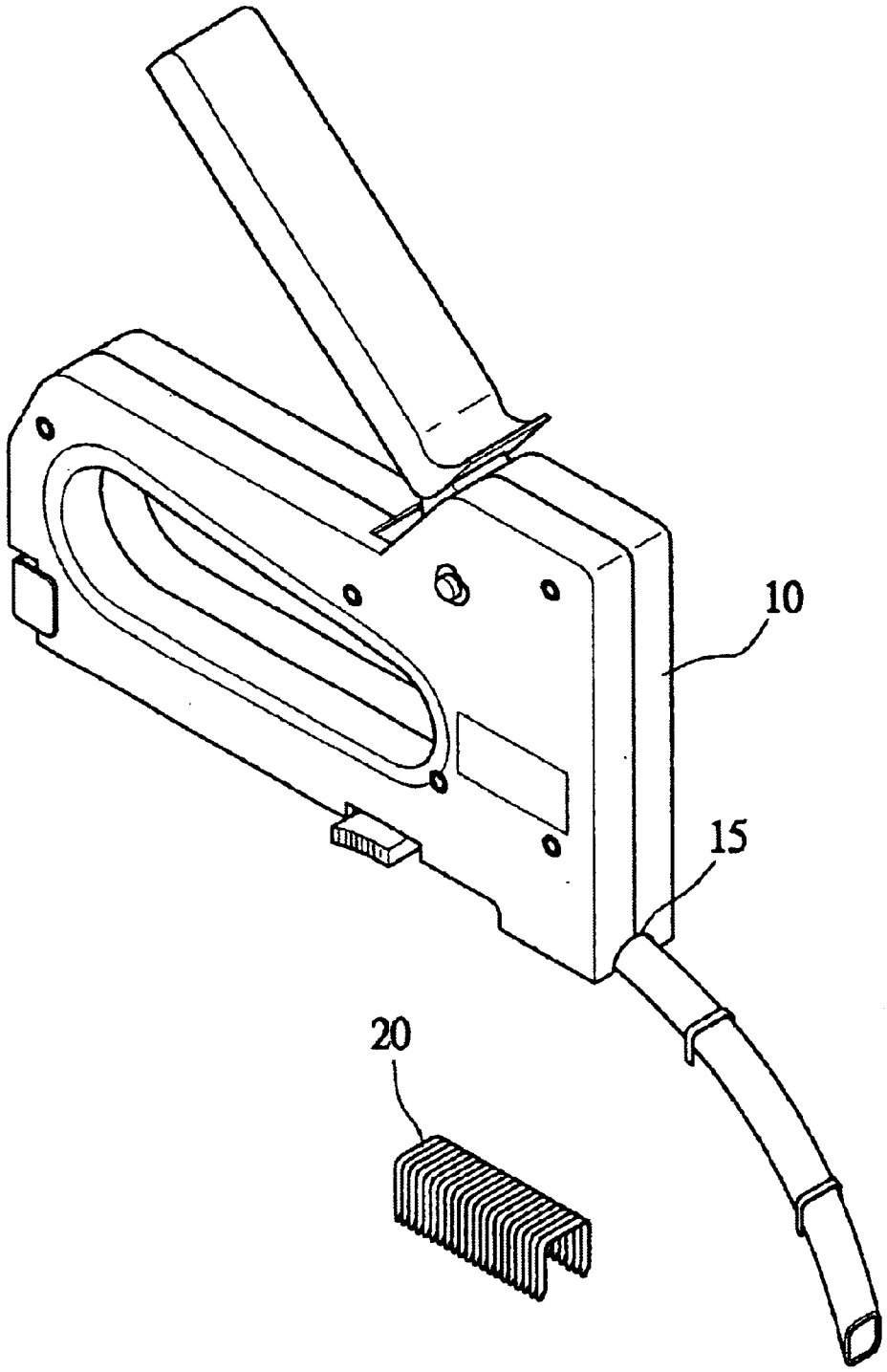
PRIOR ART FIG. 1
FIG. 1 is a perspective view of a conventional stapling device for indoor use.
Figure 2A:
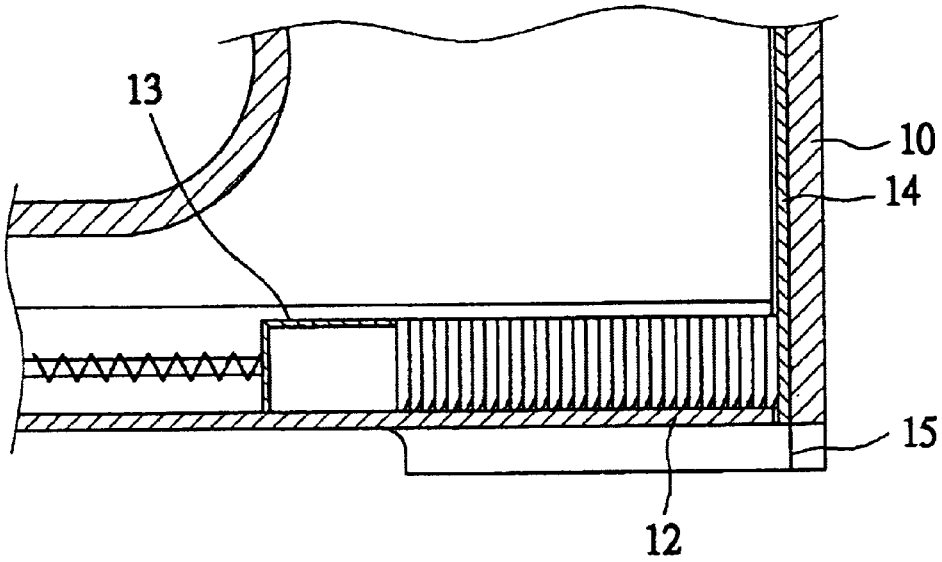
PRIOR ART FIG. 2A
FIG. 2 shows schematically the side view (FIG. 2A) and front view (FIG. 2B) of the conventional stapling device for indoor use.
Figure 2B:
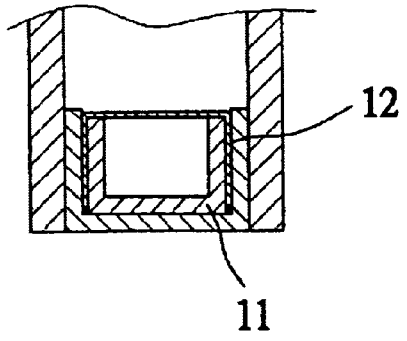
PRIOR ART FIG. 2B
Figure 3:
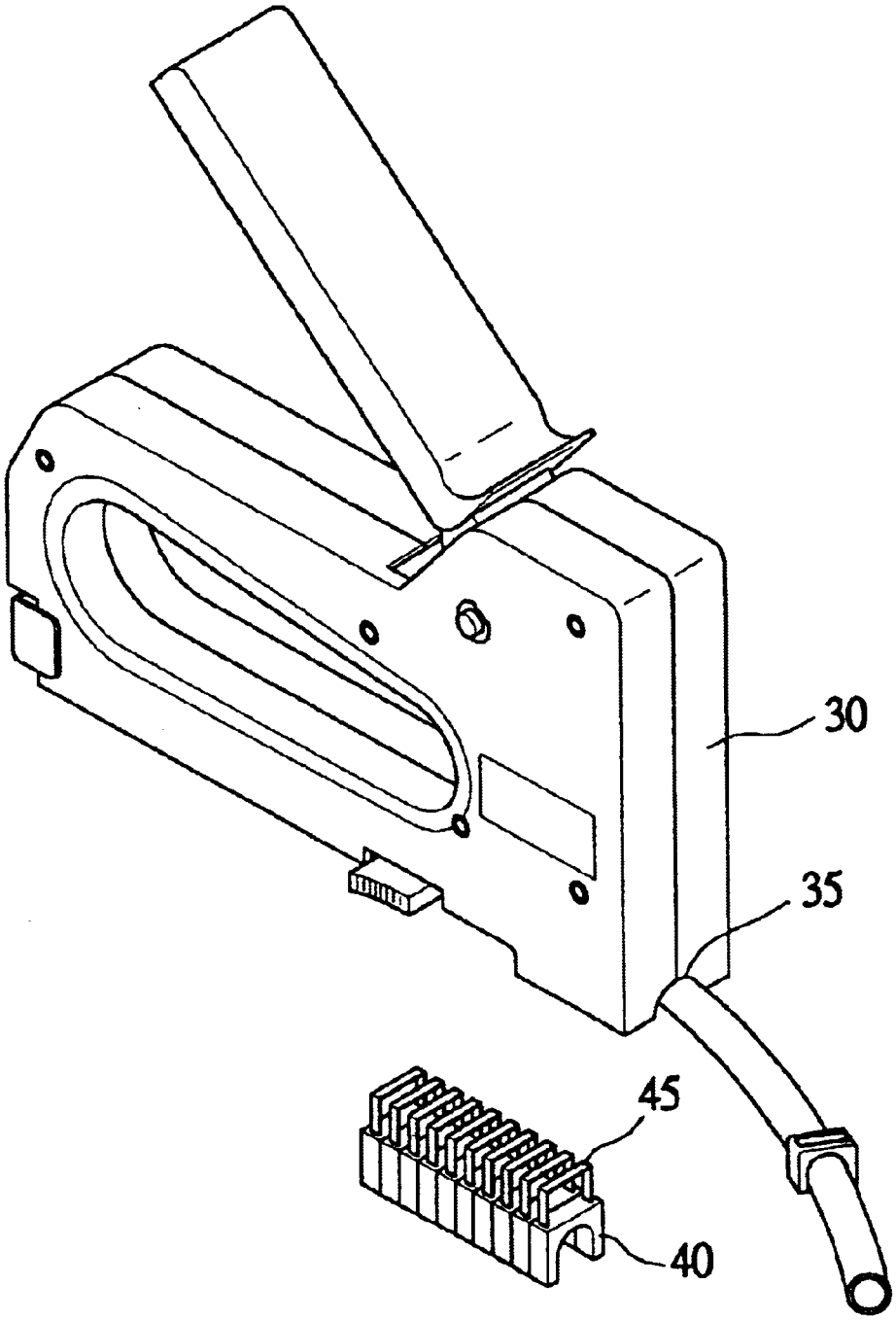
PRIOR ART FIG. 3
FIG. 3 is a perspective view of a conventional stapling device for outdoor use.
Figure 4A:
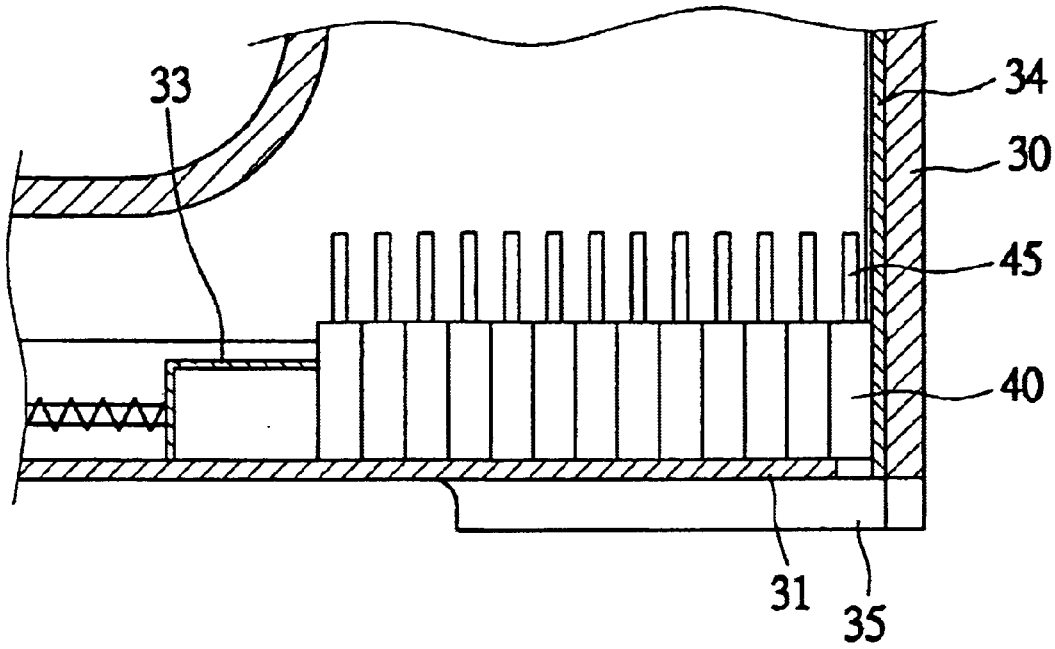
PRIOR ART FIG. 4A
FIG. 4 shows schematically the side view (FIG. 4A) and front view (FIG. 4B) of the conventional stapling device for outdoor use.
Figure 4B:
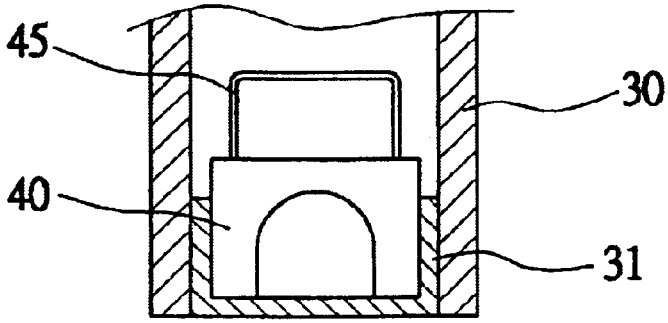
PRIOR ART FIG. 4B
Figure 5:
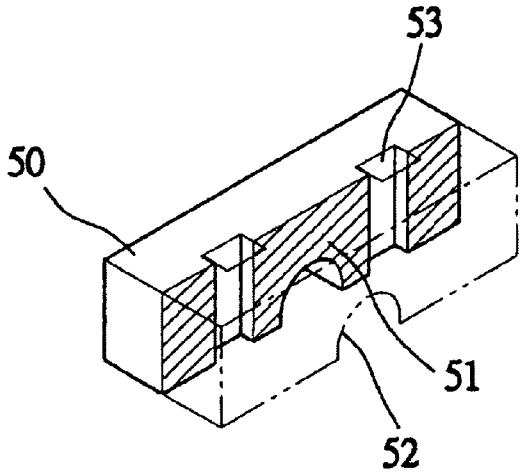
FIG. 5 is a schematic view of the wire-pressing element of the present invention, illustrating the type of the wire-pressing element and the relative position thereof.

Referring to FIG. 5, the wire-pressing element is made as one unit from a plastic material and is denoted as reference number 50. The center of the wire-pressing element 50 is provided with a wire-pressing section 51 (the wire-pressing section is of any shape, and the shape of the wire-pressing section in the present invention is a rectangular shape). The bottom face of the wire-pressing section 51 is an arch-shaped slot 52 having an opening facing downward. The shape of the slot can be semi-hemisphere or other shape. In the present invention, a semi-hemisphere is employed. The slot 52 is used for the pressing of the wire and the two sides of the wire-pressing section 51 are respectively formed into corresponding nailing holes 53. The nailing holes 53 at the front lateral edge of the wire-pressing element 50 corresponding to the front side edge of the stapling device body 10 is appropriately corresponding to the staple impaction plate 14 (as shown in FIG. 6A) such that the staple row 20 within the stapling device body 10 is inserted into the nailing holes 53 of the wire-pressing element 50 and into the ground to secure the wire (as shown in FIG. 6B), thereby the stapling device has a convenient structure with detachable wire-pressing element.

Figure 6A:
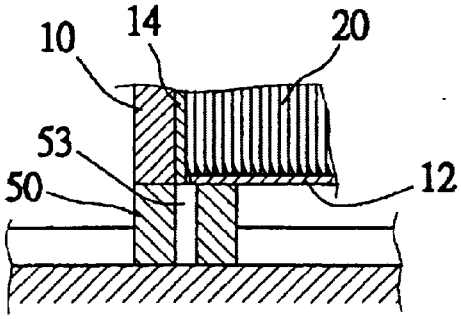
FIG. 6A is an elevation view of the wire-pressing element in accordance with the present invention.
Figure 6B:
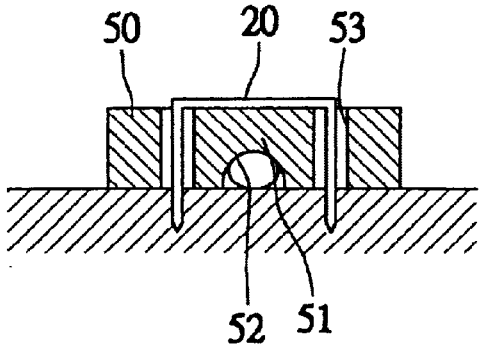
FIG. 6B is a front view of the wire-pressing element in accordance with the present invention.

In accordance with the above special design of the wire-pressing element, in operation, as shown in FIG. 6A and FIG. 5B, when the wire is to be mounted indoor, the user directly places the staple row 20 into the stapling device body 10 of the stapling device, and the staple-impacting plate 14 urges the staple row 20 on the slot seat 11 to secure the wire. When the wire is to be mounted outdoor, the user utilizes the same stapling device and the wire-pressing element 50 is located at the bottom face of the stapling device. The wire-pressing element 50 is in aligned with the front edge of the stapling device. Thus, the nailing holes 53 are in alignment with the position of the staple-impacting plate 14 (as shown in FIG. 6A). When the staple-impacting plate 14 knocks onto the staple row 20, the staple row 20 is forced into the nailing holes 53 and the staple row 20 is inserted onto the mounting object at the bottom face (as shown in FIG. 6B), so as to secure the wire. Thus, the user can use the same stapling device to complete mounting of wire indoor and outdoor, and the operability of the stapling device is convenient.

Figure 7:
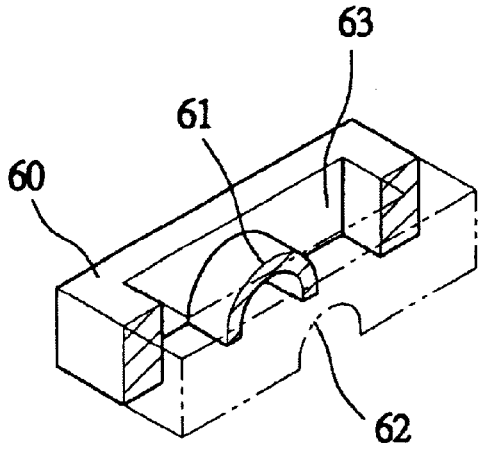
FIG. 7 is a schematic view of another preferred embodiment in accordance with the present invention.

As shown in FIG. 7, there is shown another preferred embodiment of the detachable insulation wire-pressing element of a stapling device, wherein the center of the wire-pressing element 60 is provided with an arch-shaped wire-pressing section 61 having a bottom face being a wire slot 62 with a facing downward opening for mounting wire.

Figure 8:
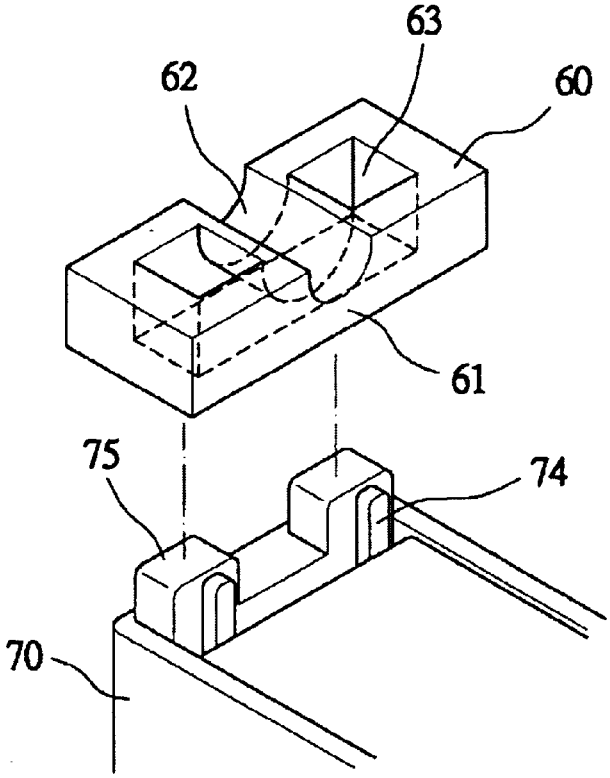
FIG. 8 is a schematic view illustrating the application of the wire-pressing element of another preferred embodiment of the present invention.

As shown in FIG. 8, the center of the wire-pressing section 61 is provided with a wire slot 62, and the two sides of the wire-pressing section 61 are provided with nailing holes 63. The bottom face of the stapling device body 70 corresponding to the front section of the staple-impacting plate 74 is formed into a position protrusion 75. The width of the nailing hole 63 is slight wider than that of the protrusion with the staple-impacting plate 74 such that the wire-pressing body can engage with the bottom face of the stapling device. This will facilitate the positioning of the wire-pressing body 60 and the staple row 20 can be mounted.

Figure 9:
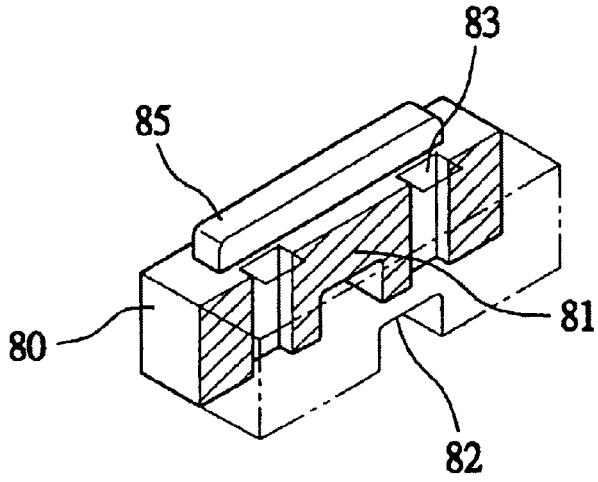
FIG. 9 is a perspective view of the wire-pressing element in accordance with the present invention.
Figure 10:
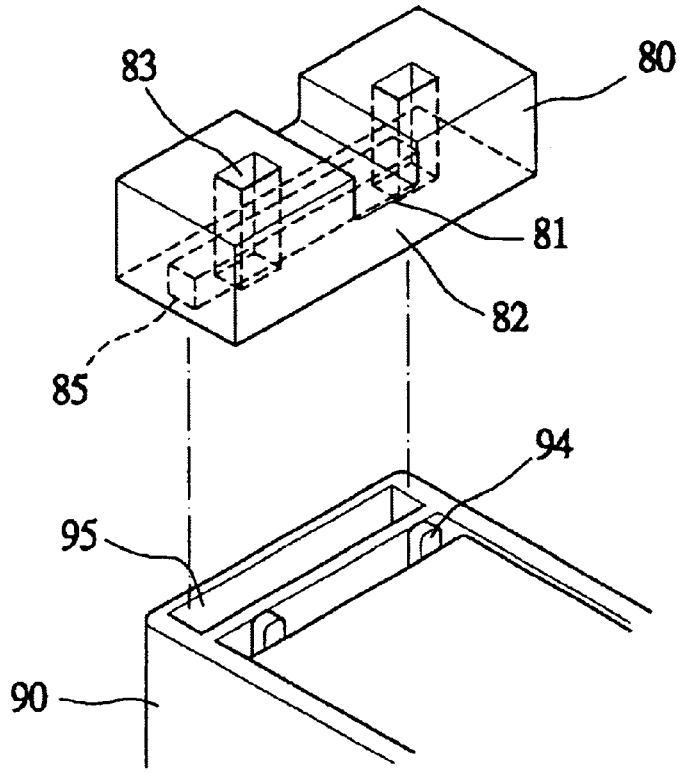
FIG. 10 is a schematic view illustrating the application of the wire-pressing element of another preferred embodiment of the present invention.

Referring to FIGS. 9 and 10, there is shown another preferred embodiment of the present invention. The insulation body 80 of the wire-pressing body is formed into a wire-pressing section 81 having a bottom face being provided with a wire slot 82. The two sides of the wire-pressing section 81 are provided with nailing holes 83. Further, the top face of the body 80, at the front edge of the nailing hole 83, is protruded with engaging block 85.

The bottom face of the stapling device body 90 corresponding to the front of the staple-impacting plate 94 is provided with a position recess 95, and the recess 95 is adaptable to the engaging block 85 of the wire-pressing body such that the wire-pressing body can be engaged with the bottom face of the stapling device so as to facilitate the mounting of the wire-pressing body 80.

In accordance with the present invention, there are advantages and improvements in effectiveness as follows:

(1) The stapling device is widely applicable. As the wire-pressing element and the rows of staples are detachable and the nailing holes of wire-pressing element are specially designed the holes can directly align with the staple-impacting plate of the stapling device such that the rows of the staples can be smoothly inserted. As a result, the stapling device can be utilized to mount outdoor wires. Thus stapling device can be utilized to mount wire indoor. Thus, the same stapling device can be used for both indoor and outdoor.

(2) Convenient Operation. As the stapling device can be utilized at different environments, the user does not require to carry different stapling device to do the mounting work and besides, no changing of stapling device is required in the course of work.

While the invention has been described with respect to preferred embodiments, it will be clear to those skilled in the art that modifications and improvements may be made to the invention without departing from the spirit and scope of the invention. Therefore, the invention is not to be limited by the specific illustrative embodiment, but only by the scope of the appended claims.

I claim:

1. A system comprising of the combination of a detachable insulation wire-pressing element and a stapling device, wherein the wire-pressing element has a wire-pressing section at a center of the element and a bottom face of the wire-pressing section is provided with a wire slot having an opening facing downward, two sides of the wire-pressing section are respectively provided with a corresponding nailing hole, and the nailing hole is corresponding in shape and size to a staple-impacting plate of the stapling device, thereby a wire-pressing element is formed, and wherein on a top face of the wire-pressing element, at a front edge of the nailing hole, is formed a protrusion with an engaging block, and further wherein the stapling device has a bottom face corresponding to a front section of the staple-impacting plate is provided with a position recess corresponding to and inter-fitting with the engaging block.

* * * * *